US009022095B2

(12) United States Patent
Volkomich et al.

(10) Patent No.: US 9,022,095 B2
(45) Date of Patent: May 5, 2015

(54) METHOD FOR THE MANUFACTURE OF CASTING MOLDS AND A DEVICE FOR REALIZING THE SAME

(71) Applicant: Zakrytoe Aktsionernoe Obschestvo "Litaform", Moscow (RU)

(72) Inventors: Anatoly Alexandrovich Volkomich, Moscow (RU); Rudolf Rudolfovich Lutts, Moscow (RU); Nikolay Ivanovich Bekh, Moscow (RU)

(73) Assignee: Zakrytoe Aktsionernoe Obschestvo "Litaform", Moscow (RU)

( * ) Notice: Subject to any disclaimer, the term of this patent is extended or adjusted under 35 U.S.C. 154(b) by 0 days.

(21) Appl. No.: 14/087,106

(22) Filed: Nov. 22, 2013

(65) Prior Publication Data

US 2014/0110076 A1 Apr. 24, 2014

Related U.S. Application Data

(63) Continuation of application No. PCT/RU2011/000967, filed on Dec. 8, 2011.

(51) Int. Cl.

| | |
|---|---|
| ***B22C 15/08*** | (2006.01) |
| ***B22C 15/28*** | (2006.01) |
| ***B22C 9/02*** | (2006.01) |

(52) U.S. Cl.

CPC ..... *B22C 15/08* (2013.01); *B22C 15/28* (2013.01); *B22C 9/02* (2013.01)

(58) Field of Classification Search

CPC ..... B22C 15/08; B22C 15/28; B22C 9/02

USPC ..... 164/37, 38, 193, 195, 200–202, 164/207–212

See application file for complete search history.

(56) References Cited

U.S. PATENT DOCUMENTS

| | | | | |
|---|---|---|---|---|
| 2,839,799 A * | 6/1958 | Herbruggen | ..... | 164/195 |
| 3,807,483 A | 4/1974 | Buhler | | |

(Continued)

FOREIGN PATENT DOCUMENTS

| | | |
|---|---|---|
| RU | 2 014 943 C1 | 6/1994 |
| RU | 2 022 684 C1 | 11/1994 |
| RU | 2 159 165 C2 | 11/2000 |
| SU | 133196 A | 1/1960 |
| SU | 288931 A | 3/1971 |

OTHER PUBLICATIONS

Advertising brochure of the company "Savelli," p. 12, 2009.

(Continued)

*Primary Examiner* — Kevin E Yoon

(74) *Attorney, Agent, or Firm* — Collard & Roe, P.C.

(57) ABSTRACT

A method of pulsed-air compacting of mold-sand in combination with compacting by compression supplements the pulsed-air compacting of the mold-sand by an operation of re-compacting the mold-sand by pressing which is performed with the pattern plate containing the patterns by the plate moving inside the cavity of the filling frame in the direction of the latticed pressing element which is subjected to a counter-pressure force corresponding in its value to the prescribed level of the half mold compaction. The method is realized with a device in which the pattern plate containing the patterns is mounted with the possibility of a reciprocal motion inside the cavity of the filling frame, and the pressing cylinder is mounted with the possibility to apply a force against the movable pattern plate.

4 Claims, 2 Drawing Sheets

(56) References Cited

Figure 1:
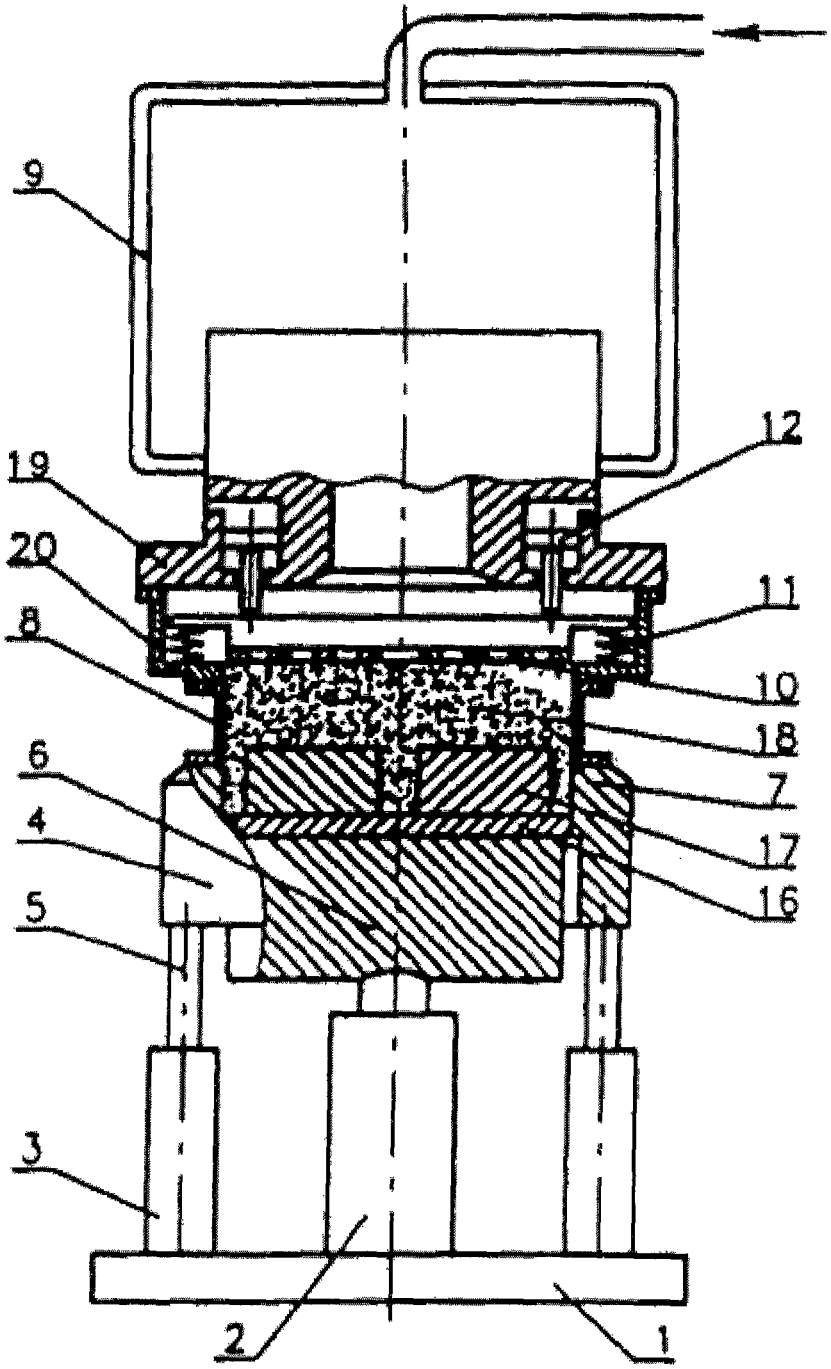

U.S. PATENT DOCUMENTS 5,957,189 A * 9/1999 Uzaki et al. ..... 164/7.1
8,186,416 B2 * 5/2012 Kaneto et al. ..... 164/18

OTHER PUBLICATIONS

International Search Report of PCT/RU2011/000967, dated Jun. 15, 2012.

* cited by examiner

METHOD FOR THE MANUFACTURE OF CASTING MOLDS AND A DEVICE FOR REALIZING THE SAME

CROSS REFERENCE TO RELATED APPLICATIONS

Applicant claims priority under 35 U.S.C. §119 of Russian Application No. 2011120718 filed May 24, 2011. Applicant also claims priority and this application is a continuation under 35 U.S.C. §120 of International Application No. PCT/RU2011/000967 filed Dec. 8, 2011, which claims priority under 35 U.S.C. §119 of Russian Application No. 2011120718 filed May 24, 2011. The International Application under PCT article 21 (2) was not published in English. The disclosures of the aforesaid International Application and Russian Application are incorporated herein by reference.

FIELD OF THE INVENTION

The present invention relates to the field of foundry and namely to the technology and the equipment for manufacturing sand and loam casting molds with the use of a method of pulsed-air compacting of mold-sand, in particular in combination with compacting by compression.

BACKGROUND OF THE INVENTION

A molder is known comprising a base, a lifter carrying pattern attachments and a casting box, and supporting columns carrying a pulsed-air head, a meter-filler and a filling frame, the meter-filler being spring-loaded against the filling frame and movable in the vertical direction into the internal cavity of the same; moreover, the device for filling the filling frame with mold-sand comprises a meter-filler spring-loaded against the filling frame and movable in the vertical direction into the internal cavity of the same, the meter-filler and the filling frame being provided with a drive for their translation, a gate being provided at the level of the upper surface of the meter-filler (see RF patent No. RU 2022684, Int. Cl. B22C 1/28, published on 15 Nov. 1994).

The method for the manufacture of casting molds realized by the above described molder comprises the following: the mold-sand is poured from a hopper into a meter-filler and a filling frame to further fill a casting box with the mold-sand, the rest of the last being kept in the filling frame, later the mold-sand is compacted by the pulsed-gas method, and the casting mold is re-compacted while moving the lifter up and displacing the remaining mold-sand from the filling frame into the casting box.

The use of the above described structures and of the method for manufacturing casting molds enables to increase productivity thanks to saving time and to combining operations. But the main drawback of the known technical solutions consists in the impossibility to provide efficient compacting of the mold-sand in the areas adjoining the casting box walls and the pattern plate, in particular in the narrow space between the patterns and the casting box walls, and in the casting box angles. The reason of the fact is a strong braking effect of friction against the casting box walls during the compacting by a pressing plate forcing the mold-sand out from the filling frame to the casting box as viewed from the drag portion of the mold. In this case, the distribution of the mold-sand compaction around the mold is not favorable and leads to a bad technology: the maximum is at the drag portion, and the minimum at the pattern plate. The combination of so called "upper" compaction with the pulsed action onto the mold-sand with compressed air somewhat reduces but does not completely eliminate this effect.

A method for the manufacture of sand molds is known, which comprises the steps of: compacting the mold-sand by a compressed gas impulse and additional mechanical pressing by upper compaction with a latticed pressing plate, and a device for realizing the mentioned process is known, comprising a base, a lifter, a casting box, a pulsed-gas head mounted fixedly above the casting box and linked to a system of compressed gas supply, a latticed pressure plate mounted in the lower part of the pulsed-gas head with the possibility of a reciprocal motion with regard to the same in the direction of the casting box, provided by a separate piston drive (see U.S. Pat. No. 3,807,483, Int. Cl. B22C 15/28, published on 30 Apr. 1974).

Nevertheless, the above mentioned method and device provide the mold-sand compacting in the casting box with the same drawbacks as in the previous case. What is more, the existence of a separate piston drive makes the structure more complicated and requires additional energy expenditures, and the static pressure of the plate to the upper surface of the mold-sand is less efficient than the plate compression in a dynamical regime. The mechanical compacting after the end of the pulsed-gas compaction is less efficient as well than when it is performed simultaneously with the last, while the mold-sand is in a fluid state.

A method for the manufacture of casting molds is known, which comprises the steps of: filling with mold-sand the casting box and the filling frame containing patterns located inside them, mounted on a pattern plate, leveling of the mold-sand surface by moving a multi-position (piston-type) pressing plate together with a prominent scraper fixed on the same, into a position above the casting box, complete lifting of the pattern plate in the filling frame, the mold-sand being moved without its compaction from the frame to the casting box and from the casting box to the free space above the same, pulsed-air pre-compacting of the mold-sand by the effect of the compressed air passing through the moving multi-position pressing plate, and active (full) compressing from above with the compressing elements of the controlled-pressure pressing plate, with the following pulling-through of the pattern, the mold-sand being poured into the casting box and the filling frame under the effect of gravity, and a device realizing said process is known as well, comprising a base, a pressing cylinder, a molding table with a carrier of the pattern plate with patterns, a filling frame with a casting box mounted on the last, a pulsed-air head located above the molding table and linked to a system of compressed air supply, a movable pressing plate with a multi-position (piston-type) pressing element, the filling frame being built-in into the molding table and made with the possibility to place molded casting boxes onto the frame and to take them away from the same, the pattern plate with patterns being placed with the possibility of a reciprocal motion in the cavity of the filling frame, and the pressing cylinder being placed with the possibility to apply force to the movable pattern plate (Advertising brochure of the company "Savelli", p. 12, November 2009).

The above described method and device remedy only in part the main drawbacks of the previous analogs: not rational and not uniform distribution of the mold-sand compaction.

The closest to the technical solution according to the present invention, as to its technical nature, are a method for filling a filling frame and a casting box with mold-sand, and for pulsed compacting of the mold-sand by compressed gas with a simultaneous dynamical re-compacting of the upper layer of the mold-sand with a movable latticed pressing plate moving under the effect of the energy of a compressed gas impulse, as well as a device for compacting the mold-sand, comprising a base, a lifter carrying a filling frame and pattern attachments, a casting box, a pulsed-gas head fixedly mounted above the casting box and linked to a system of compressed gas supply, a latticed pressing plate mounted in the lower part of the pulsed-gas head with a possibility of a reciprocal motion relative to the pulsed-gas head in the direction of the casting box, the pressing plate being linked to the pulsed-gas head via elastic elements made in the form of springs or cables, besides, the device is provided with a cylinder mounted in the pulsed-gas head with the possibility of free contact of its rod with the pressing plate (see the RF patent No. RU 2159165, Int. Cl. B22C 15/28, published on 20 Nov. 2000).

Said method and device increase the efficiency of the mold-sand compacting by a compressed-gas impulse and enable a better mold-sand 5 density distribution around the whole volume of the mold compared to the previous case.

Nevertheless, they show the same drawbacks of the compacting from above, characterizing two previous cases described, which represents the reason hampering a wide use of said invention. The dynamic character of compacting with a latticed element does not modify the nature of the image of problems characteristic for the compacting from above and that of the not rational mold-sand compaction distribution around the volume of the mold.

SUMMARY OF THE INVENTION

The essence of the present invention task is to develop a method and a device for the manufacture of casting molds, that could enable a technologically rational distribution of the mold-sand compaction around the volume of the mold, the maximum density being near the pattern plate and the minimum density, near the drag portion, that could provide an efficient mold-sand compacting near the walls and in the angles of the casting boxes, as viewed from the joining plane of the half mold, as well as an efficient mold-sand compacting in the narrow pockets between the walls of high patterns and casting boxes, at the same time without too high mold-sand compaction above the patterns, while providing favorable conditions for carrying out the pattern pull-through operation with minimal drafts.

A technical result of the use of the present inventions consists in the provision of a technologically rational process for compacting casting molds, enabling to get a mold with uniform strength characteristics in various areas of its volume for a wide range of castings and patterns of various complexity, and, as a result, the improved precision and the decrease of the number of defects in the castings, the increased metal content in the molds thanks to a more compact disposition of the patterns with regard to the casting box walls and to their increased number on a pattern plate.

The above mentioned technical result is obtained due to the fact that in the method for the manufacture of casting molds comprising the filling with mold-sand of the filling frame and the casting box containing patterns mounted on a pattern plate, the pulsed-air compacting of the mold-sand by the action of compressed air passing through a movable, elastically mounted pressing element, the re-compacting of the mold-sand by pressing and the pattern pull-through from the half molds, according to the present invention solution, the re-compacting by pressing is performed with the pattern plate and its patterns while moving the plate inside the cavity of the filling frame in the direction of the pressing latticed element, which is fixed in the low position before and during the pressing operation and to which a counter-pressure force corresponding to the prescribed half mold compaction level is applied, therewith:

during the compacting and the pull-through operations, the filling frame supporting the casting box is maintained in a fixed position, and the counter-pressure force applied to the pressing element, is released after the end of the pressing before starting the pull-through, and the pull-through operation is carried out by the pressing return motion while moving the pattern plate containing the patterns inside the fixed filling frame with the casting box, furthermore, the mold-sand fills the casting box and the filling frame in layers, by forming a stream of loose mold-sand and pouring it from a height, the mold-sand fall height being in the range of 1 to 3 m.

It is necessary to observe that for a smaller height value, the kinetic energy of the stream provided could be insufficient for obtaining the efficient filling of the narrow gaps with the mold-sand, and further increase in height of the stream will not considerably improve the quality of the casting box filling with the mold-sand but will lead to an important increase of the height of the fillers.

Furthermore, in the device for realizing the process according to the invention, comprising a base, a pressing cylinder, a molding table, a filling frame, a pattern plate with patterns, a pulsed-air head mounted above the molding table and linked to a compressed air supply system, a movable latticed pressing element mounted in the lower part of the pulsed-air head with an elastic fixture, and a mechanism for filling with mold-sand the filling frame and the casting box, according to the present invention, the filling frame is built-in into the molding table and is made with the possibility to place on it the molded casting boxes and to take them away, the pattern plate with the patterns being mounted with the possibility of a reciprocal motion in the cavity of the filling frame and the pressing cylinder is mounted with a possibility to apply a force to the movable pattern plate, the device being additionally provided with one cylinder or with a system of interrelated cylinders fixing the latticed pressing element in the low position and linked to pressure sources located on a traverse in the way to enable their extended rods to apply a force to a pressing element elastically mounted on the traverse for providing a counter-pressure force.

Moreover, the device is provided with a power system for locking the filling frame with the casting box during the pressing and the pull-through operations, made of cylinders with rods that press down the filling frame with the casting box to the traverse, located on the base or on the lifting plate of the molding table.

The device for filling with mold-sand the filling frame and the casting box comprises a metering hopper with a controlled shutter, a belt feeder and a drive for direct and reverse relative translation of the molding table and of the feeder in the horizontal plane, made with the possibility to provide reciprocal motions.

According to a second embodiment, the device for filling the filling frame and the casting box with mold-sand comprises a metering hopper with a controlled shutter, a belt feeder and an oscillating mold-sand duct located below the feeder and provided with a drive for reciprocal and angular motions.

The idea of the inventions consists in providing, while implementing the process and the device according to the invention, the solution of the task assigned and the technical result expected.

The comparison of the method and the device according to the invention with the known ones enables to state they satisfy the criterion "novelty", and the absence of our new characteristics in the previous art means they satisfy the criterion "inventive level". Preliminary tests performed enable us to state they satisfy the criterion "industrial usefulness".

Figure 2:
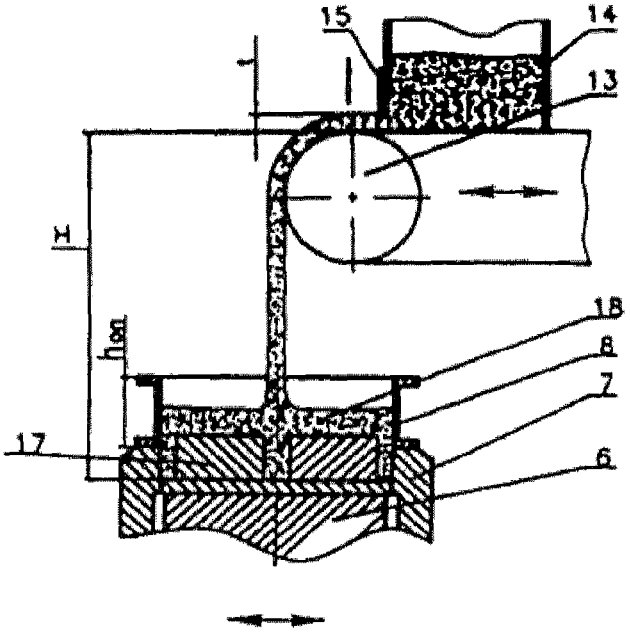
Figure 3:
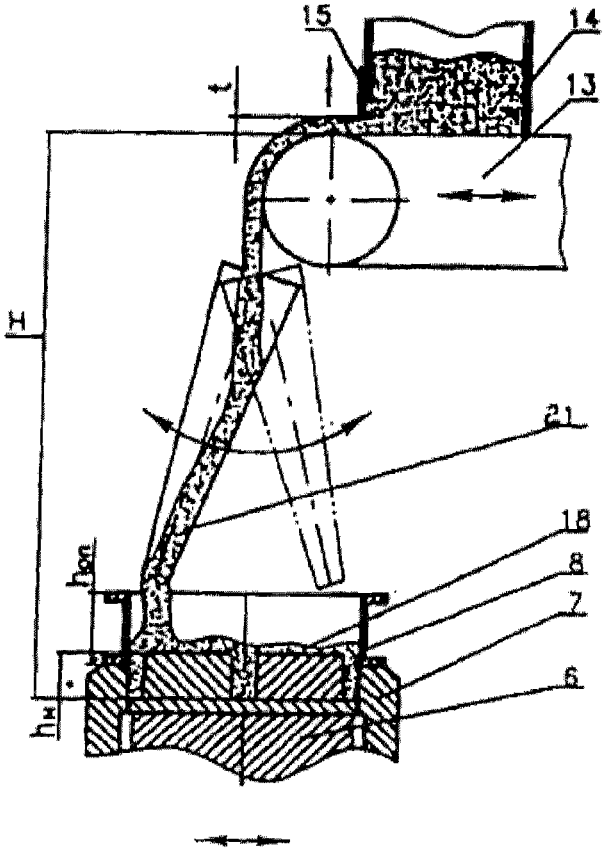

FIG. 1 shows a device (sectional view) for realizing the method for the manufacture of casting molds during the operations of compacting and pulling-out, before starting the compacting process, FIG. 2 schematically shows a device carrying out the operation of filling the filling frame and the casting box with mold-sand, and FIG. 3 shows an embodiment of the device with an oscillating mold-sand duct.

PREFERRED EMBODIMENT TO PUT THE INVENTION INTO PRACTICE

The device for the manufacture of casting molds comprises a base 1, a pressing cylinder 2, cylinders 3 of the locking mechanism, a molding table 4, guiding plungers 5, a chair plate 6, a filling frame 7, a casting box 8, a pulsed-air head 9, a latticed pressing element 10, an elastic suspension 11 of the pressing element, counter-pressure cylinders 12, a belt feeder 13, a metering hopper 14, a controlled shutter 15, a pattern plate 16, patterns 17, the mold-sand 18, a traverse 19, a compression plate 20 and a mold-sand duct 21.

To carry out the method, the device is operating as follows. In the filling operation, the mold-sand from the metering hopper 14 is transferred by the feeder 13 through a longitudinal opening partly shut down by the controlled shutter 15 the position of which determines the initial thickness of the roughing mold-sand stream. The mold-sand stream falls from above into the casting box 8 on the pattern plate 16. The molding table 4 with the filling plate 7 reciprocates relative to the feeder 13, or the oscillating mold-sand duct 21 performs reciprocal and angular motions above the casting box 8 with a determined rate. This provides for filling the casting box 8 with the mold-sand 18 in layers. The mold-sand stream falling from above accelerates, and the kinetic energy of the falling mold-sand stream 18 provides for a precise reproduction of the fine relief of the patterns 17 and a good filling with the mold-sand of the narrowest gaps between the patterns 17 and the patterns and the casting box walls 8. Regulating the thickness of the outgoing layer of the mold-sand 18 and the rate of relative motion of the table 4 and the feeder 13 or the mold-sand duct 21, one can control the parameters of the process (depending on the particularities of the configuration and of the pattern disposition, the properties of the mold-sand, etc.).

The range of values for the height of falling for the mold-sand 18 is determined by the following. As shown by experimental studies, the height of 1 to 3 m is the most efficient. At lesser height values, the energy of the stream is low and can be insufficient for the efficient reproduction of the patterns 17 relief and for filling narrow "pockets" on the pattern plate 16, whereas the increase of the height of the falling stream to values more than 3 m becomes inefficient due to the increasing air resistance and leads to an unjustified size (height) increase of the molder.

The volume of the mold-sand poured is regulated depending on the time of the feeder 13 operation or according to the initial level of mounting the chair plate 6 with the pattern plate 16 inside the filling frame 7. In this case, the volume of mold-sand is prescribed with some excess compared to the needed volume, for obtaining the necessary compacting of the half mold.

The molding table 4 is moved by the drive to the position of the compacting and pulling-through operation. The rods of the cylinders 3 for the locking mechanism of the molding table 4 with the casting box 8 are extended and press down the table 4 with the casting box 8 to the supporting plane of the compression plate 20 locked on the traverse 19, fixing them in this position.

After that, the pressing process starts up: the rod of the pressing cylinder 2 applies a force to the chair plate 6 with the pattern plate 16 and the patterns 17, and starts moving them, squeezing the mold-sand 18 out of the filling frame to the casting box 8. Before starting, at the initial moment or during the pressing operation, a compressed air impulse is sent through the latticed pressing element 10 to carry out a preliminary compacting of the mold-sand. During the pressing operation, the mold-sand 18 abuts against the latticed element 10, and the friction of the mold-sand against the walls of the filling frame 7 and of the casting box 8 brakes its motion and presses it down to the pattern plate 16, enabling an efficient compacting of the mold-sand near the pattern plate and in the areas close to the walls of the frame and of the casting box.

During the pressing operation, a part of the mold-sand above the patterns 17 can be extruded through the latticed pressing element 10, preventing by the same any excessive compaction of the mold-sand above the patterns.

Before starting and during the pressing operation, the movable latticed pressing element 10 is locked in the lower position by the extended rods of the cylinders 12 linked to the counter-pressure source. The value of this counter-pressure is selected depending on the requirements to the compaction level of the mold.

During the pressing operation, when the mold-sand pressure on the latticed pressing element 10 becomes equal to the prescribed counter-pressure force, the latticed pressing element starts moving, squeezing out the rods of the counter-pressure cylinders 12. In this case, all the mold as a whole is pulled through the casting box 8, before the chair plate 6 with the pattern plate 16 reaches the mechanical stops in the table, fixing the prescribed position of the mold-sand drag in the half mold (inside, in the plane or protruding above the jointing plane with the casting box). The position of the stops is regulated and is assigned according to technology particularities.

Thus, independently of the variations of the mold-sand properties, a stable compacting and geometry of the half mold are provided.

After the pressing end and before the pulling through operations, the rods of the counter-pressure cylinders 12 are carried away to the upper position and the latticed pressing element 10 is equally separated from the drag portion of the half mold by the elastic suspension 11. As a result, the half mold is elastically discharged, and all the elastic deformations are withdrawn to the drag portion of the half mold. After that, from the casting box that is discharged but remaining fixedly pressed by the cylinders 3 against the plane of the compression plate 20 of the traverse 19, the patterns 17 are extracted in the return motion of the chair plate 6 with the pattern plate 16 and the patterns 17. And only after the pulling-through and the lowering the pressing cylinder 2 rod, the rods 3 of the locking mechanism of the table are lowered to separate the molding table 4 with the casting box 8 from the traverse 19.

In this way, a precise pulling through of the patterns is provided by the return motion of the pressing operation that does not depend on errors in sizes or on the casting box condition, without the influence of scrap welded together with the casting box, of the mold-sand entrapment on the table surface, on the casting box drag portion, etc.

Combining the lower pressing (by the pattern plate) with the preliminary pulsed-air compacting of the mold-sand provides for an efficient, controlled and stable compaction of high-complexity molds, with narrow pockets and small gaps between the patterns and between the patterns and the casting box walls. Thanks to the preliminary pulsed-air compaction of the mold-sand, not only its somewhat more favorable distribution is provided but the friction coefficient increases significantly and, respectively, the favorable effect of the mold-sand friction against the casting walls is markedly increased under the lower pressing (when the pattern plate moves with the patterns) and the compaction of the adjacent areas of the mold is improved.

Simultaneously, any excessive compaction of the mold-sand is prevented from the areas above the patterns to the gaps between the patterns and to the pattern pockets. Such results are impossible to get at the true lower compacting (with the pattern plate) or at combined upper pressing together with an air impulse, when it is impossible to obtain simultaneously an efficient mold-sand compaction near the casting box walls or to avoid excessive mold-sand compaction above the patterns, the last drawback leading to the mold-sand flow brake and to a worse mold-sand compaction between the patterns and in their pockets.

A necessary condition for an efficient compacting the mold-sand by an air impulse and a subsequent pressing is the presence of the mold-sand in narrow spaces and its uniform state (without hollows, lumps, etc.).

The process of feeding the mold-sand into a casting box according to the present invention provides, thanks to the kinetic energy of a mold-sand stream, an efficient filling of the most narrow pockets in the patterns and of the gaps between the patterns, as well as between the patterns and the casting box walls, providing by the same the possibility of its favorable redistribution and compaction by the jets of air filtered through the mold-sand during the impulse, and by the stress forces arising in the mold-sand, at subsequent pressing.

It is necessary to note, that the "forced pressing through" of the compacted half mold via the casting box along its internal walls, when the pressing element moves back at the last pressing stage, increases significantly the strength of the mold (thanks to the strengthening shear deformations) and improves its coherence with the casting box walls (thanks to the coefficient of external friction of the mold-sand during its forced slipping along the casting box walls), and in the combination with the above described particularities of carrying out the pulling-through operation, it significantly stabilizes the process of molding, making it little sensitive to various disturbing factors, before all to variations of the mold-sand properties, etc.

Thus, a high efficiency of the method and of the device according to the present invention is provided by the delimitation and the internal unity, by the coherence and the mutual strengthening effects and by the dependence of all the main stages of the process:

the efficient operation of filling with mold-sand of a casting box containing tightly arranged patterns of a complicated configuration, providing the possibility of further molding a print with complicated configuration and relief;

the efficient operation of technologically rational compacting the mold-sand on all the working surfaces and around the whole volume of a half mold with a complicated configuration (both without loose or overcompacted areas, the maximally compacted areas being near the patterns and the compactness decreasing in the direction from the patterns to the drag portion of the half mold);

the efficient pulling-through of patterns with minimal declivities from a fixed half mold discharged from elastic deformations and deprived of wedged overcompressed areas or elements, thanks to providing the possibility to optimize the mold-sand compaction distribution around the mold.

The efficiency of the method is built up by the following:

increase in precision and a lower number of defective castings;

increase in productivity thanks to a higher number of castings in a mold.

INDUSTRIAL APPLICABILITY

The above reported advantages of the technical solutions according to the present invention enable them to find a wide industrial use in foundry.

The invention claimed is:

1. A device for the manufacture of casting molds, comprising a base, a pressing cylinder, a molding table, a filling frame, a pattern plate with patterns, a pulsed-air head mounted above the molding table and linked to a compressed air supply system, a movable latticed pressing element mounted in the lower part of the pulsed-air head with the use of an elastic fixture, and a mechanism for filling with mold-sand the filling frame and the casting box, in which the filling frame is built-in into the molding table and is made with the possibility to place on it molded casting boxes and to take them away, the pattern plate with the patterns being mounted with the possibility of a reciprocal motion in the cavity of the filling frame, and the pressing cylinder is mounted with the possibility to apply a force to the movable pattern plate, the device being additionally provided with one cylinder or with a system of interrelated cylinders fixing the latticed pressing element in the low position and linked to pressure sources located on a traverse in the way to enable their extended rods to apply a force to the pressing element elastically mounted on the traverse for providing a counter-pressure force.

2. The device of claim 1 in which, it is provided with a power system for locking the filling frame with the casting box during the pressing and the pull-through operations, made of cylinders with rods that press down the filling frame with the casting box to the traverse, located on the base or on the lifting plate of the molding table.

3. The device of claim 1 in which the mechanism for filling with mold-sand the filling frame and the casting box comprises a metering hopper with a controlled shutter, a belt feeder and a drive for direct and reverse relative translation of the molding table and of the feeder in the horizontal plane, made with the possibility to provide reciprocal motions.

4. The device of claim 1 in which the mechanism for filling with mold-sand the filling frame and the casting box comprises a metering hopper with a controlled shutter, a belt feeder and an oscillating mold-sand duct located under the feeder and provided with a drive for reciprocal and angular motions.

* * * * *